US005832347A

United States Patent [19]

Kawai et al.

[11] Patent Number: 5,832,347

[45] Date of Patent: Nov. 3, 1998

[54] TONER FOR RECORDING ELECTROSTATIC IMAGE AND ELECTROSTATIC RECORDING METHOD AND APPARATUS USING THE SAME

[75] Inventors: Katsuya Kawai; Tsuneaki Kawanishi; Masayasu Anzai, all of Ibaraki, Japan

[73] Assignee: Hitachi Koki Co., Ltd., Tokyo, Japan

[21] Appl. No.: 943,109

[22] Filed: Oct. 3, 1997

[30] Foreign Application Priority Data

Oct. 4, 1996 [JP] Japan ..... 8-263899
Sep. 5, 1997 [JP] Japan ..... 9-240773

[51] Int. Cl.[6] ..... G03G 15/08

[52] U.S. Cl. ..... 399/252; 430/111

[58] Field of Search ..... 399/252, 130; 430/107–111, 120–123

[56] References Cited

U.S. PATENT DOCUMENTS 5,120,631 6/1992 Kanbayashi et al. ..... 430/111 X
5,164,780 11/1992 Ohno et al. ..... 430/105 X
5,418,102 5/1995 Kotaki et al. ..... 430/109
5,422,215 6/1995 Takagi et al. ..... 430/111 X
5,578,409 11/1996 Kotaki et al. ..... 430/109

FOREIGN PATENT DOCUMENTS 8-15986 1/1996 Japan ..... G03G 15/08
8-3660 1/1996 Japan ..... G03G 9/087

OTHER PUBLICATIONS

Japan Hardcopy '91 papers by H. T. Macholdt, pp. 13–16, 1991.

*Primary Examiner*—R. L. Moses
*Attorney, Agent, or Firm*—Sughrue, Mion, Zinn, Macpeak & Seas, PLLC

[57] ABSTRACT

A toner for recording electrostatic image having a volume-average particle diameter of from 6 to 10 $\mu$m, which exhibits a compression stress of from 50 to 500 kgf/cm$^2$ at the middle temperature between room temperature and the glass transition temperature of the toner, and a compression stress of from 0.2 to 10 kgf/cm$^2$ at the middle temperature intermediate between the glass transition temperature and the softening temperature of the toner.

5 Claims, 3 Drawing Sheets

TONER FOR RECORDING ELECTROSTATIC IMAGE AND ELECTROSTATIC RECORDING METHOD AND APPARATUS USING THE SAME

FIELD OF THE INVENTION

The present invention relates to a toner for recording an electrostatic image, which is for use in developing an electrostatic latent image formed by electrophotographic process, electrostatic printing process, electrostatic recording process or the like, and to an electrostatic recording method and apparatus using the toner.

BACKGROUND OF THE INVENTION

In the electrophotographic process, an image is recorded, for example, as follows, among various printing and recording processes. That is, a photoconductor is electrically charged, and then exposed to light to form an electrostatic latent image thereon. The electrostatic latent image thus formed is then developed with a particulate toner comprising a coloring matter. The resulting toner image is transferred to a recording medium such as recording paper, and then fixed to obtain a recorded image.

In the foregoing electrostatic recording process, the development of an electrostatic latent image with a particulate toner and the fixing of a toner image on a recording medium are particularly important steps. As the method for developing an electrostatic latent image to a toner image there has heretofore been often used a magnetic brush development method using a two-component developer comprising a magnetic carrier and a toner which can provides an image having excellent quality at a high rate. In addition, as the method for fixing a toner image there has been often used a heat roller fixing method capable of fixing at a high thermal efficiency and a high rate.

Recently, with the development of data apparatus, a laser beam printer has been developed which employs laser beam to expose a photoconductor to provide a computer-commanded modulated signal, to thereby reproduce a recorded image in dots. Particularly, laser beam printers in these days are required to provide images having higher quality, and thus employ laser beam having a reduced diameter to provide a dot density as high as from 600 to 1,200 dpi (dots/inch). Accordingly, the diameters of particulate toners and carriers are reduced for developing a fine electrostatic latent image. Thus, a particulate toner having a volume-average particle diameter of not more than 10 $\mu$m and a particulate carrier having a weight-average particle diameter of not more than 100 $\mu$m are put on the application.

With respect to fixing, heat roller fixing methods are often used as described above. From the following standpoint of views, a toner has been desired to be fixed by applying a lower temperature and pressure with a heat roller, to thereby realize reduced electric power consumed in the fixing heater and driving motor.

(1) To inhibit the overheat deterioration of the printer and hence the thermal deterioration of parts in an apparatus;

(2) To shorten the warm-up time required until fixing is made possible since the fixing device has been actuated;

(3) To inhibit fixing failure due to heat absorption by the recording medium, thus making it possible to form an image in continuous passing of paper; and (4) To reduce the load applied to the heat roller, making it possible to simplify and miniaturize the structure of the fixing device.

The use of a particulate toner having a particle diameter of not more than 10 $\mu$m is liable to some problems. That is, with regard to the development step, although the use of a particulate toner having such a diameter provides a high resolution and a high dot density reproducibility, making it possible to reduce the amount of the toner required to obtain the same image density, the rise in the specific surface area of the toner causes a rise in the charge amount per unit weight of the toner, resulting in the drop of image density. Further, since the surface area of individual toner is reduced, the charge amount per individual toner is reduced. This tends to cause the adhesion of the toner to non-image area (fogging) and flying of the toner. Furthermore, a fluidity drop tends to be caused to thereby result in the deterioration of handling ability during transportation. Moreover, because of its high adhesion and weak impact strength, such a particulate toner tends to cause carrier stain (carrier spent), to thereby shorten the life of the developer. Further, such a particulate toner can be hardly removed from a photoconductor, to thereby tend to cause a thin toner film formation (filming) on the photoconductor during printing.

With regard to fixing, a particulate toner having the above described diameter requires much energy to obtain the same fixing strength than toners having a larger particle diameter. Accordingly, toners constituting images are partially transferred to the surface of a heat roller during fixing. The toner thus transferred is then transferred again to the subsequent sheet of recording paper to cause stain on the image, which is called offset. Further, the production of such a particulate toner is liable to decrease the yield at the grinding and classification steps, which increase the production cost. Because of the above described difficulties, it is generally difficult to put a toner having a particle diameter of less than 6 $\mu$m into practical use. In practice, toner particles are generally used after classified to select a toner having an average particle diameter of from 6 to 10 $\mu$m.

However, even a toner having an average particle diameter falling within the above described range is also liable to the above described various difficulties. Attempts have been made to overcome these difficulties and to obtain a finer image with high reliability. With regard to chargeability, for example, if the particle diameter of a toner is reduced, the charge amount per individual toner is reduced to cause the defects as described above. In this respect, attempts have been made to enhance the dispersibility of pigment or charge controlling agent constituting the toner to secure the desired charge, as described in H. T. Macholdt, "Japan Hardcopy '91 papers", page 13, 1991. In addition, another attempt has been made, which uses an aromatic polyester resin comprising an amorphous polymer block and a crystalline polymer block in an appropriate proportion as a binder, to improve the low temperature fixability and anti-offset properties of the toner, as described in JP-B-8-3660 (The term "JP-B" as used herein means an "examined Japanese patent publication").

With respect to carrier, the particle diameter thereof is reduced to have a weight-average particle diameter of 100 $\mu$m, accompanying with the reduction of the particle diameter of the toner, to increase the specific surface area of the carrier that leads to the improvement in the frictional chargeability of the toner. However, a carrier having a particle diameter of less than 40 $\mu$m exhibits a reduced magnetic force and thus can be easily adhered to the image carrier by electrostatic attraction. Accordingly, carrier toners are subjected to classification to select a carrier having an average particle diameter of from 40 to 100 $\mu$m. A developer comprising a mixture of the above described toner and carrier having an average particle diameter falling within the respective range has a small particle diameter itself. An electrophotographic process is proposed such that a developer having such a small particle diameter exhibits not only an improved chargeability, but also exerts an improved effect in recycling the toner recovered from the surface of an image carrier (JP-A-8-15986 (The term "JP-A" as used herein means an "unexamined published Japanese patent application")).

Dut to the above described improvements, such a particulate toner and developer has become more and more applicable into practical use in copiers, printers, etc.

However, when printing is effected in a practical electrostatic recording apparatus, particularly when printing is repeatedly effected at a rate as high as 10 pages or more per minute, the above described problems peculiar to particulate toners tend to occur, to thereby result in reduced life of developer due to carrier spent by toner and reduced life of a photoconductor due to toner filming on the photoconductor. Further, the image thus formed can be hardly provided with a desired fixing strength. In particular, it is necessary that the temperature and pressure of heat rollers be raised at the fixing step. This makes it difficult to raise the reliability of the fixing device, to simplify and miniaturize the fixing device and to reduce the cost.

SUMMARY OF THE INVENTION

It is therefore an object of the present invention to provide a toner for recording an electrostatic image, which comprises a particulate toner having a volume-average particle diameter of from 6 to 10 $\mu$m, and which stably provides an image without reducing the life of a developer and a photoconductor, even if applied in a high speed printing of electrostatic image recording process.

It is another object of the present invention to provide an electrostatic recording method and an electrostatic recording apparatus, which require less energy for fixing and lower heat roller temperature and pressure when heat roller fixing system is employed.

Other objects and effects of the present invention will become apparent from the following description.

The above described objects of the present invention have been achieved by providing:

a toner for recording electrostatic image having a volume-average particle diameter of from 6 to 10 $\mu$m, which exhibits a compression stress of from 50 to 500 kgf/cm$^2$ at the middle temperature between room temperature and the glass transition temperature of the toner, and exhibits a compression stress of from 0.2 to 10 kgf/cm$^2$ at the middle temperature between the glass transition temperature and the softening temperature of the toner.

BRIEF DESCRIPTION OF THE DRAWINGS

By way of example and to make the description more clear, reference is made to the accompanying drawings in which.

DETAILED DESCRIPTION OF THE INVENTION

The present invention is described in detail below.

As described above, the use of a particulate toner having a volume-average particle diameter of from 6 to 10 $\mu$m provides the toner with an increased specific surface area and hence an increased contact area per unit weight. As a result, such a toner has deteriorated fluidity, to thereby tends to cause deterioration in handling ability during toner transportation. Further, because of its strong adhesion strength and weak impact resistance, the particulate toner of the above described size tends to cause carrier spent and filming of photoconductor, and therefore the life of the developer and photoconductor tend to be shortened. Moreover, the fixing of the toner of the above described size requires an increased energy. Accordingly, the fixing temperature and pressure of the heat roll need to be adjusted to higher values.

The present inventors paid attention to the mechanical properties of toners. Specifically, it can be considered that toners desirably have properties such that the toners exhibit a great mechanical strength at the steps where they are used in the form of powder such as developing step, transferring step, cleaning step, etc., and exhibit a small mechanical strength at the fixing step. Accordingly, the present inventors investigated the relationship between the mechanical properties of toners and the practical performances of toners at operating steps.

In this investigation, the compression stress of toners developed under application of a pressure was evaluated as one of mechanical properties of the toners to determine the optimum compression stress value under the conditions required at the above described operating steps.

Figure 2:
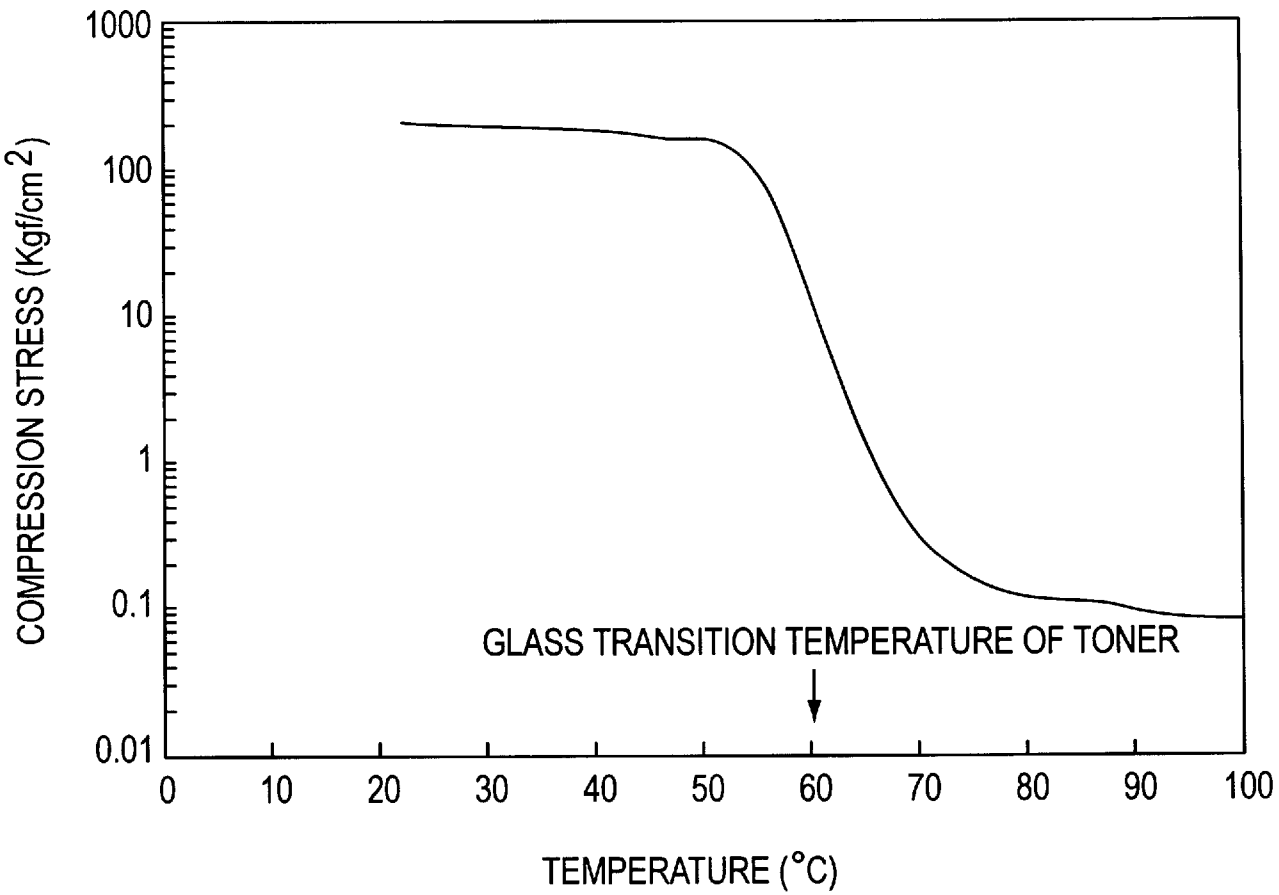
FIG. 2 is a graph illustrating the relationship between the compression stress of an ordinary toner and temperatures.

In general, the compression stress of a toner changes with a change of temperature as shown in FIG. 2. In some detail, a toner exhibits a great compression stress within a temperature range of from room temperature to the glass transition temperature of the toner. The toner exhibits a reduced compression stress within a temperature range of from higher than the glass transition temperature of the toner to the softening temperature of the toner. That is, the compression stress of a toner shows a great change at its glass transition temperature.

The ambient temperature of a toner falls within the range from room temperature to the glass transition temperature of the toner at the developing step, transferring step and cleaning step, and falls within the range from the glass transition temperature of the toner to the softening temperature of the toner at the fixing step, where heat is supplied from a heat roll to the toner.

Therefore, the inventors evaluated the compression stress of a toner within the above described temperature ranges, the life of a developer and a photoconductor, and the reliability of image such as fixing strength, to thereby determine the relationship between the compression stress and practical properties of the toner. Thus, the optimum compression stress of the toner has been obtained.

As a result, it was found that the optimum compression stress of the toner at the middle temperature between room temperature and the glass transition temperature of the toner and at the middle temperature between the glass transition temperature of the toner and the softening temperature of the toner are from 50 to 500 kgf/cm$^2$ and from 0.2 to 10 kgf/cm$^2$, respectively. The term "room temperature" used in the present invention means 26° C.

If the compression stress of the toner falls below the above defined ranges within the various temperature ranges, the toner causes carrier spent or filming of photoconductor, to thereby shorten the life of the developer and photoconductor. On the contrary, if the compression stress of the toner exceeds the above defined range within the various temperature ranges, the toner is less apt to be deformed with respect to pressure and therefore has a reduced fixing strength, to thereby tend to cause offset. Moreover, such a toner is less apt to be ground during preparation. As a result, the yield of the toner is reduced, to thereby raise the cost for toners.

As described above, there is a close relation between the mechanical properties and the practical performances of toners. By designing and preparing a toner such that its compression stress shows an appropriate value depending on temperature, a highly reliable electrostatic recording method can be provided.

The compression stress of the toner according to the present invention can be measured by the following method. In some detail, about 1 g of the toner is molded under a pressure of 4 t/cm$^2$ by means of a hydraulic press to have a column form having a sectional area of 1 cm$^2$ and a height of about 10 mm. The toner sample thus formed is then compressed at a rate of 10 mm/min at a constant temperature by means of a compression testing machine (Type TF-30 strograph T, available from Toyo Seiki Seisakusho, Ltd.). In this manner, the stress-strain characteristics of the toner are measured. The maximum compression stress thus determined is defined as the compression stress of the toner.

In practicing the present invention, the optimization of the compression stress of the toner is important particularly for polyester toners. The present invention exerts a great effect of stabilizing image. As the toner binder there is generally used a styrene-acryl resin or polyester resin, if the toner is adapted to be fixed by a heat roller. If low temperature fixing is aimed as in the present invention, the polyester resin is favorable because it has a high glass transition temperature and thus can have a low softening temperature, allowing low temperature fixing while maintaining the desired anti-blocking properties, anti-offset properties and fluidity of the toner.

There are many kinds of polyester resins. Of these polyester resins, aromatic polyester resins are suitable for toner. In order to enhance the anti-offset properties during heat roller fixing, a partially crosslinked polyester resin prepared from monomers comprising a crosslinkable component is effective.

The partially crosslinked polyester resin includes those synthesized using a monomer selected from the following monomers. Examples of trifunctional or higher polyfunctional monomers for constituting the crosslinked portion include polyvalent alcohol monomers such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene, and polyvalent carboxyl acid monomers such as 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-butanetricarboxylic acid, 1,2,5-hexanetricarboxylic acid, 1,3-dicarboxy-2-methylcarboxypropene, 1,3-dicarboxy-2-methyl-2-methylene carboxypropane, 1,3-dicarboxy-2-methyl-2-methylenecarboxy propane, tetra (methylenecarboxy)methane, 1,2,7,8-octanetetracarboxylic acid, enpole trimeric acid, and anhydride thereof.

Examples of the divalent alcohol monomer constituting the basic skeleton of the polyester resin include diols such as ethylene glycol, diethylene glycol, triethylene glycol, 1,2-propylene glycol, 1,3-propylene glycol, 1,4-butanediol, neopentyl glycol and 1,4-butenediol, 1,4-bis(hydroxymethyl) cyclohexane, etherified bisphenol A such as bisphenol A, hydrogenated bisphenol A, polyoxyethylenated bisphenol A and polyoxypropylenated bisphenol A, and other divalent alcohol monomers.

Examples of the divalent carboxylic acid monomer include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebasic acid, malonic acid, anhydride thereof, dimers of lower alkylester and linolenic acid, and other divalent organic acid monomers.

The dehydropolycondensation of the above described alcohol with the above described acid makes it possible to synthesize a partially-crosslinked polyester resin. However, a polyester resin contains a large amount of unreacted hydroxyl groups or carboxyl groups at the end of the molecule or in the main molecular chain and thus can easily absorb moisture. Therefore, the resulting toner is prone to change its electrical characteristics, particularly electrostatic characteristics, with environmental change. In order to prevent this defect, attempts have been made to improve the environmental resistance of the toner by the graft copolymerization of a polyester resin with a styrene/acryl resin having a polar group which reacts with the hydroxyl group or carboxyl group in the polyester resin. Such a styrene/acryl-modified polyester can be preferably used in the present invention. The content of a trifunctional or higher polyfunctional monomer component in these polyester resins is preferably from 1 to 30 mol %. If the polyfunctional monomer content falls below this range, it causes offset during heat roller fixing. On the contrary, if the polyfunctional monomer content exceeds this range, the resulting toner exhibits a deteriorated fixability.

The toner of the present invention generally comprises the binder and a coloring matter. The contents of the binder and the coloring matter in the toner are from 80 to 90% by weight and from 5 to 15% by weight, respectively. The toner of the present invention preferably further comprises a charge controlling agent, a releasing agent and an external additive. Generally, the content of the charge controlling agent is from 1 to 5% by weight, the content of the releasing agent is from 0 to 5% by weight, the content of the external additive is from 0 to 5% by weight, in the toner. In a preferred embodiment, the content of the binder is from 85 to 90% by weight, and the content of the coloring metter is from 2 to 4% by weight.

Thus, the glass transition temperature of the toner comprising styrene/acryl resin or polyester resin is preferably from 50° C. to 70° C. If the glass transition temperature of the toner falls below 50° C., the toner exhibits insufficient anti-offset properties, grindability, anti-blocking properties, anti-filming properties and durability. On the contrary, if the glass transition temperature of the toner exceeds 70° C., the toner exhibits a deteriorated low-temperature fixability.

Further, the softening temperature of the toner is preferably from 110° C. to 140° C. If the softening temperature of the toner falls below 110° C., the toner exhibits deteriorated anti-offset properties. On the contrary, if the softening temperature of the toner exceeds 140° C., the toner exhibits deteriorated low-temperature fixability.

The glass transition temperature and softening temperature of the toner of the present invention can be determined by the following method. In some detail, the glass transition temperature of the toner is determined according to differential scanning calorimetry (DSC). About 10 to 20 mg of the toner is heated at a constant rate of 10° C./min from room temperature to about 160° C. In this manner, the glass transition temperature of the toner is determined from the point of intersection of the base line with the inclination of endothermic peak.

On the other hand, the softening temperature of the toner is determined by means of an elevated flow tester having a nozzle having a diameter of 1 mm and a length of 1 mm. About 1 g of the toner is preheated to a temperature of 80° C. for about 5 minutes. The toner is then heated at a rate of 6° C./min under a load of 30 kgf/cm$^2$. In this manner, the fall of the plunger in the flow tester is measured with temperature to obtain a plunger fall-temperature curve (softening flow curve). The temperature at which the plunger fall is half the height of S-like curve portion in the softening flow curve (½ flow temperature) is then defined as softening temperature.

The toner comprising a styrene/acryl resin or polyester resin having the above described melt properties can be fixed at low temperatures even where it is used in a finely particulated state. However, if a partially-crosslinked resin such as polyester resin is used, the resulting toner exhibits a great mechanical strength. This makes it difficult to be fixed under a low pressure. Therefore, by appropriately selecting the toner materials, formulation and production conditions to regulate the compression stress of the toner within the range defined in the present invention, a good fixing strength can be obtained at a low temperature under a low pressure. Thus, a highly reliable electrostatic recording method is provided.

Examples of known preparation process of, e.g., non-magnetic two-component dried toner include mechanical grinding methods, spray dry methods, microcapsulation methods, polymerization methods, etc. These methods have respective features, and one suitable for the intended purpose can be appropriately selected among these methods, depending on the production efficiency (cost) and the characteristics to be imparted to the toner.

For example, a mechanical grinding method which can be applied to the preparation of the toner of the present invention is described below. Mechanical grinding methods does not require any solvent in production, and therefor is advantageous in operating ability. First, toner raw materials such as a binder resin, a coloring matter, a charge controlling agent, etc. are pre-mixed in a powder mixing machine, and then melt-kneaded to uniformly disperse the raw materials. The rotational speed, operating time, temperature, shape of an agitating blade, etc. of the pre-mixing machine and the melt kneader are important factors. After cooling the mixture thus melt-kneaded, the resulting product is coarsely ground to the size of several mm order, and then finely ground to the center diameter of from 6 to 10 $\mu$m. The thus finely ground product has a considerably broad diameter distribution, and therefore is classified using to remove fine particles of 5 $\mu$m or less and coarse particles of 20 $\mu$m or more, to thereby obtain toner particles having a predetermined diameter range.

As the final step after the classification, additives such as silica, alumina, titanium oxide, aliphatic alkali metal, fine resin powder can be added and adhered to the toner surface. Alternatively, the toner may be sprayed into high-temperature air flow to effect spherodizing treatment, and then be adhered thereto these additives.

Various manufacturing conditions in the above described mechanical grinding process should be considered and appropriately selected to achieve the intended purposes. In particular, the melt-kneading temperature is an important factor and should be appropriately selected depending on the kind of the binder.

Figure 1:
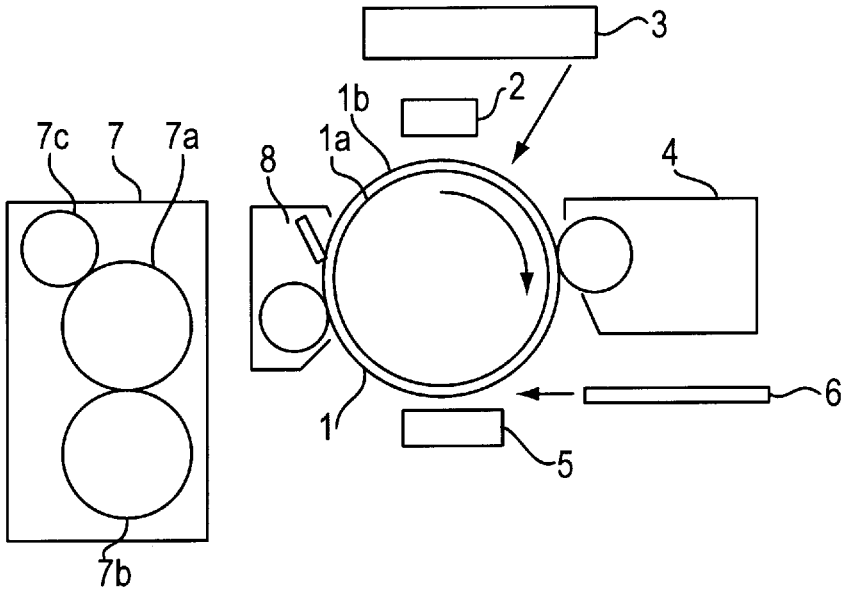
FIG. 1 is a diagram illustrating the structure of an apparatus to which the toner of the present invention is applied.

The arrangement of an apparatus to which the present invention can be applied is described with referring to FIG. 1.

An image carrier 1 comprises an organic photoconductor (OPC) 1*b* provided on, e.g., base pipe 1*a*. The image carrier 1 shown in FIG. 1 is supported clockwise rotatably.

As the image carrier 1 rotates, it is electrically charged uniformly. The image carrier 1 is then imagewise exposed to light from an exposing apparatus 3 to form an electrostatic latent image thereon.

The electrostatic latent image thus formed on the image carrier 1 is then developed in a developing zone in a developing device 4 to form a toner image. The toner image thus formed is moved to a transfer position as the image carrier 1 rotates. The toner image is then transferred to a recording medium 6 by the action of a transferring device 5. The recording medium 6 thus having a toner image retained thereon is then conveyed by a fixing device 7 comprising, e.g., heat roll 7*a* and pressure roll 7*b*. The toner image is heated under pressure in the fixing device 7 so that it is fixed to the recording medium 6.

Separately, the toner which has not been transferred to the recording medium 6 and left on the image carrier 1 is then removed and recovered by a cleaning device 8.

In FIG. 1, shown at the reference numeral 7*c* is an oil tank roller which supplies a releasing agent such as silicone oil onto the surface of the heat roll 7*a*.

Figure 3:
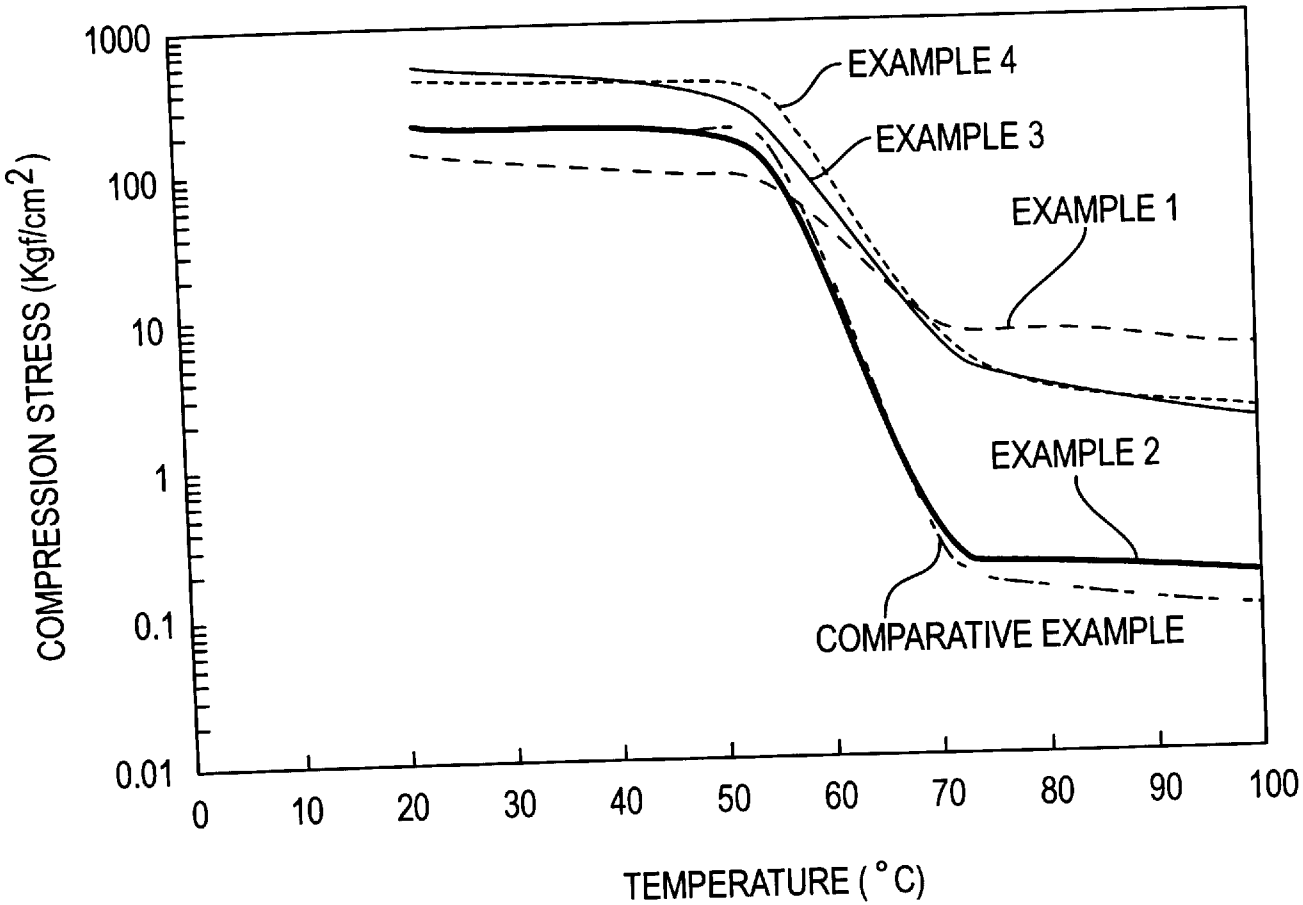
FIG. 3 is a graph illustrating the relationship between the compression stress of the toner according to the present invention and temperatures.

The present invention will be described in greater detail with reference to the following Examples, but the present invention should not be construed as being limited thereto. (Comparison of Examples 1 to 4 and Comparative Example 1 is shown in FIG. 3.)

EXAMPLE 1

Using an electrophotographic laser beam printer comprising an OPC as a photoconductor, printing was conducted at a rate of 60 sheets per minute (printing process speed: 26.7 cm/sec) at an OPC charged potential of −650 V, a residual potential of −70 V, a development bias potential of −400 V and a development zone contrast potential of 330 V. The developing machine employed as a toner a negatively-charged toner having a volume-average particle diameter of 8 $\mu$m, a glass transition temperature of 64° C. and a softening temperature of 127° C., which was prepared from: a partially-crosslinked polyester resin, as a binder, comprising 20 mol % of trimellitic acid and 24 mol % of terephthalic acid, as acid components, and 34 mol % of a bisphenol A type propylene oxide adduct and 22 mol % of a bisphenol A type ethylene oxide adduct, as alcohol components; 8 wt % of a coloring matter (Carbon Black #44, manufactured by Mitsubishi Chemical Corporation); 2 wt % of a charge controlling agent (Bontron S34, manufactured by Hodogaya Chemical Industries); 4 wt % of a releasing agent (Viscol 550P, manufactured by Sanyo Chemical Industries); and 0.5 wt % of an external additive (silica) (R972, manufactured by Nippon Aerosil Co., Ltd.).

As a carrier there was used a magnetite carrier (electrical resistance: $4.1\times10^8$ Ω•cm) having a weight-average particle diameter of 100 $\mu$m coated with an electrically-conducting agent-containing silicon resin. A developer having a toner concentration of 2.5 wt % was prepared. In a magnetic brush development method, the photoconductor and the development roll were moved in the same direction with adjusting a development gap (distance between the photoconductor and the development roll sleeve) to 1.2 mm and a circumferential speed ratio (development roll/photoconductor) to 3, to thereby effect reversal development. In this manner, an image was formed.

The fixing device used herein comprised a heat roll composed of an aluminum core metal coated with a thin film (40 μm) of a fluororesin (tetrafluoroethylene/perfluoroalkylvinyl ether copolymer: PFA) and having a heater lamp provided in the central portion of the heat roll, and a pressure roll composed of an aluminum core metal coated with a silicone rubber layer (thickness: 7 mm) having a rubber hardness of about 30 and PFA tube as an outermost layer. The fixing was effected at a process rate of 26.7 cm/sec under a pressure load of 50 kgf. The outer diameter of the heat roll and the pressure roll were each 60 mm. The width of the contact area (nip) of the two rolls was controlled to about 7 mm. The temperature of the heat roll was controlled to 190° C.

The cleaning portion of the heat roll was equipped with a brush type oil tank roller. A mechanism which wipes offset toner with a silicone oil was employed.

Using the foregoing laser beam printer, continuous printing was effected. In this manner, the life of the developer and the photoconductor and the fixing strength of the image were examined. The compression stress of the toner was evaluated as one of mechanical properties. As a result, the toner exhibited a compression stress of 93 kgf/cm$^2$ at the middle temperature between room temperature and the glass transition temperature of the toner, i.e., about 45° C., and a compression stress of 6 kgf/cm$^2$ at the middle temperature between the glass transition temperature of the toner and the softening temperature thereof, i.e., about 95° C. As a result of the continuous printing by the laser beam printer, the developer worked over 300,000 pages or more. The photoconductor worked over 200,000 pages or more. The image thus formed exhibited a good fixing strength. During printing, no offset occurred.

EXAMPLE 2

As a toner there was used a negatively-charged toner having a volume-average particle diameter of 7 μm, a glass transition temperature of 54° C. and a softening temperature of 112° C., prepared from: a partially-crosslinked polyester resin, as a binder, made of 12 mol % of trimellitic acid, 20 mol % of terephthalic acid and 15 mol % of hexadecenedicarboxylic acid, as acid components, and 41 mol % of a bisphenol A type propylene oxide adduct and 12 mol % of a bisphenol A type ethylene oxide adduct, as alcohol components; 8 wt % of a coloring matter (Carbon Black #44, manufactured by Mitsubishi Chemical Corporation); 2 wt % of a charge controlling agent (Bontron S-34, manufactured by Hodogaya Chemical Industries); 4 wt % of a releasing agent (Viscol 550P, manufactured by Sanyo Chemical Industries); and 0.5 wt % of an external additive (silica) (R972, manufactured by Nippon Aerosil Co., Ltd.). As a carrier there was used a magnetite carrier (electrical resistance: $1.9\times10^8$ Ω•cm) having a weight-average particle diameter of 90 μm coated with an electrically-conducting agent-containing silicon resin. Thus, a developer having a toner concentration of 2.5 wt % was prepared. An image was then formed by reversal development.

The same laser beam printer as used in Example 1 was used, except that the fixing device used herein comprised a heat roll having an aluminum core metal coated with a thin film (20 μm) of a fluororesin (tetrafluoroethylene/perfluoroalkylvinyl ether copolymer: PFA) and a heater lamp provided in the central portion thereof, and a pressure roll having an aluminum core metal coated with a silicone rubber layer (thickness: 5 mm) having a rubber hardness of about 20 and PFA tube as an outermost layer. The fixing was effected at a process rate of 26.7 cm/sec under a pressure load of 30 kgf. The outer diameter of the heat roll and the pressure roll were each 40 mm. The width of the contact area (nip) of the two rolls was controlled to about 4 mm. The temperature of the heat roll was controlled to 170° C. The cleaning portion of the heat roll was equipped with a brush type oil tank roller. A mechanism which wipes offset toner with a silicone oil was employed.

Using the foregoing laser beam printer, continuous printing was effected. In this manner, the life of the developer and the photoconductor, and the fixing strength of the image were examined. The compression stress of the toner was evaluated as one of mechanical properties. As a result, the toner exhibited a compression stress of 173 kgf/cm$^2$ at the middle temperature between room temperature and the glass transition temperature of the toner, i.e., about 40° C., and a compression stress of 0.2 kgf/cm$^2$ at the middle temperature between the glass transition temperature of the toner and the softening temperature of the toner, i.e., about 80° C. As a result of the continuous printing by the laser beam printer, the developer worked over 200,000 pages or more. The photoconductor worked over 100,000 pages or more. The image thus formed exhibited a good fixing strength. During printing, no offset occurred.

EXAMPLE 3

As a toner there was used a negatively-charged toner having a volume-average particle diameter of 7 μm, a glass transition temperature of 64° C. and a softening temperature of 119° C. prepared from: a styrene/acryl copolymer as a binder; 8 wt % of a coloring matter (Carbon Black #44, manufactured by Mitsubishi Chemical Corporation); 2 wt % of a charge controlling agent (Bontron S-34, manufactured by Hodogaya Chemical Industries); 4 wt % of a releasing agent (Viscol 550P, manufactured by Sanyo Chemical Industries); and 0.5 wt % of an external additive (silica) (R972, manufactured by Nippon Aerosil Co., Ltd.). As a carrier there was used a magnetite carrier (electrical resistance: $1.9\times10^8$ Ω•cm) having a weight-average particle diameter of 90 μm coated with an electrically-conducting agent-containing silicon resin. Thus, a developer having a toner concentration of 2.5 wt % was prepared. An image was then formed by reversal development.

The same laser beam printer as used in Example 1 was used, except that the fixing device used herein comprised a heat roll having an aluminum core metal coated with a thin tube (40 μm) of a fluororesin (tetrafluoroethylene/perfluoroalkylvinyl ether copolymer: PFA) and a heater lamp provided in the central portion thereof, and a pressure roll having an aluminum core metal coated with a silicone rubber layer (thickness: 7 mm) having a rubber hardness of about 30 and PFA tube as an outermost layer. The fixing was effected at a process rate of 26.7 cm/sec under a pressure load of 50 kgf. The outer diameter of the heat roll and the pressure roll were each 60 mm. The width of the contact area (nip) of the two rolls was controlled to about 7 mm. The temperature of the heat roll was controlled to 180° C. The cleaning portion of the heat roll was equipped with a brush type oil tank roller. A mechanism of wiping offset toner with a silicone oil was employed.

Using the foregoing laser beam printer, continuous printing was effected. In this manner, the life of the developer and the photoconductor, and the fixing strength of the image were examined. The compression stress of the toner was evaluated as one of mechanical properties. As a result, the toner exhibited a compression stress of 356 kgf/cm$^2$ at the middle temperature between room temperature and the glass transition temperature of the toner, i.e., about 40° C., and a compression stress of 2.5 kgf/cm$^2$ at the middle temperature between the glass transition temperature of the toner and the softening temperature thereof, i.e., about 90° C. As a result of the continuous printing by the laser beam printer, the developer worked over 300,000 pages or more. The photoconductor worked over 200,000 pages or more. The image thus formed exhibited a good fixing strength. During printing, no offset occurred.

EXAMPLE 4

As a toner there was used a negatively-charged toner having a volume-average particle diameter of 8 $\mu$m, a glass transition temperature of 58° C. and a softening temperature of 126° C., prepared from: a binder resin obtained by the graft copolymerization of an aromatic polyester with styrene/acryl; 8 wt % of a coloring matter (Carbon Black #44, manufactured by Mitsubishi Chemical Corporation); 2 wt % of a charge controlling agent (Bontron S-34, manufactured by Hodogaya Chemical Industries); 4 wt % of a releasing agent (Viscol 550P, manufactured by Sanyo Chemical Industries); and 0.5 wt % of an external additive (silica) (R972, manufactured by Nippon Aerosil Co., Ltd.). As a carrier there was used a magnetite carrier (electrical resistance: $1.9\times10^8$ Ω•cm) having a weight-average particle diameter of 90 $\mu$m coated with an electrically-conducting agent-containing silicon resin. Thus, a developer having a toner concentration of 2.5 wt % was prepared. An image was then formed by reversal development.

The same laser beam printer as used in Example 1 was used, except that the fixing device used herein comprised a heat roll having an aluminum core metal coated with a thin tube (40 $\mu$m) of a fluororesin (tetrafluoroethylene/perfluoroalkylvinyl ether copolymer: PFA) and a heater lamp provided in the central portion thereof and a pressure roll having an aluminum core metal coated with a silicone rubber layer (thickness: 7 mm) having a rubber hardness of about 30 and PFA tube as an outermost layer. The fixing was effected at a process rate of 26.7 cm/sec under a pressure load of 50 kgf. The outer diameter of the heat roll and the pressure roll were each 60 mm. The width of the contact area (nip) of the two rolls was controlled to about 7 mm. The temperature of the heat roll was controlled to 180° C. The cleaning portion of the heat roll was equipped with a brush type oil tank roller. A mechanism of wiping offset toner with a silicone oil was employed.

Using the foregoing laser beam printer, continuous printing was effected. In this manner, the life of the developer and the photoconductor, and the fixing strength of the image were examined. The compression stress of the toner was evaluated as one of mechanical properties. As a result, the toner exhibited a compression stress of 374 kgf/cm$^2$ at the middle temperature between room temperature and the glass transition temperature of the toner, i.e., about 40° C., and a compression stress of 2.9 kgf/cm$^2$ at the middle temperature between the glass transition temperature of the toner and the softening temperature thereof, i.e., about 80° C. As a result of the continuous printing by the laser beam printer, the developer worked over 300,000 pages or more. The photoconductor worked over 200,000 pages or more. The image thus formed exhibited a good fixing strength. During printing, no offset occurred.

COMPARATIVE EXAMPLE 1

A toner was prepared in the same manner as in Example 2, except that the kneading temperature during the toner preparation was lowered by 10° C. Thus, a negatively-charged toner having a volume-average particle diameter of 7 $\mu$m, a glass transition temperature of 55° C. and a softening temperature of 110° C. was obtained. The toner thus obtained was then evaluated in the same manner as in Example 2. As a result, the toner exhibited a compression stress of 174 kgf/cm$^2$ at the middle temperature between room temperature and the glass transition temperature of the toner, i.e., about 40° C., and a compression stress of 0.13 kgf/cm$^2$ at the middle temperature between the glass transition temperature of the toner and the softening temperature thereof, i.e., about 80° C. As a result of the continuous printing by the laser beam printer, the developer and the photoconductor each worked merely over 100,000 pages or less. The image thus formed exhibited a good fixing strength. However, some offset occurred during printing.

Evaluations in the above described Examples 1 to 4 and Comparative Example 1 were made under the condition that the room temperature is 26° C.

If the average particle diameter of the toner falls below 6 $\mu$m, charging is insufficiently controlled, to thereby cause adhesion of the toner to the non-image area or flying of the toner. On the contrary, if the average particle diameter of the toner exceeds 10 $\mu$m, the resulting image is rough rather than minute. Further, if the average particle diameter of the carrier falls below 40 $\mu$m, the carrier is adhered to the photoconductor. On the contrary, if the average particle diameter of the carrier exceeds 100 $\mu$m, the resulting image is rough.

As described above, a particulate toner/developer designed and prepared such that it exhibits a compression stress of from 50 to 500 kgf/cm$^2$ at the middle temperature between room temperature and the glass transition temperature of the toner, and a compression stress of from 0.2 to 10 kgf/cm$^2$ at the middle temperature between the glass transition temperature of the toner and the softening temperature thereof, makes it possible to stably provide a high quality image even if continuous printing is repeated.

In accordance with the present invention, a particulate toner for electrostatic image recording, having a volume-average particle diameter of from 6 to 10 $\mu$m, is provided which provides an image without reducing the life of the developer and the photoconductor, even if high speed printing is repeated.

Furthermore, an electrostatic recording method and an electrostatic recording apparatus are provided which require a reduced energy for fixing and lowered heat roller temperature and pressure, when heat roller fixing system is employed.

While the invention has been described in detail and with reference to specific examples thereof, it will be apparent to one skilled in the art that various changes and modifications can be made therein without departing from the spirit and scope thereof.

What is claimed is:

1. A toner for recording electrostatic image having a volume-average particle diameter of from 6 to 10 $\mu$m, which exhibits a compression stress of from 50 to 500 kgf/cm$^2$ at the middle temperature between room temperature and the glass transition temperature of the toner, and a compression stress of from 0.2 to 10 kgf/cm$^2$ at the middle temperature intermediate between the glass transition temperature and the softening temperature of the toner.

2. The toner according to claim 1, wherein the glass transition temperature and the softening temperature are from 50° C. to 70° C. and from 110° C. to 140° C., respectively.

3. The toner according to claim 1, wherein said toner comprising, as a binder, at least one of a styrene/acryl copolymer, an aromatic polyester containing a trifunctional or higher polyfunctional monomer component in an amount of from 1 to 30 mol %, and a resin obtained by the graft copolymerization of the aromatic polyester with a styrene/acryl resin.

4. An electrostatic recording process comprising the steps of:

developing an electrostatic latent image formed on an image carrier with a developer to form a toner image;

transferring said toner image onto a recording medium; and heating said recording medium having said toner image formed thereon under pressure given by a pair of fixing rolls to fix said toner image on said recording medium, wherein said developer comprises:

a toner having a volume-average particle diameter of from 6 to 10 $\mu$m, which exhibits a compression stress of from 50 to 500 kgf/cm$^2$ at the middle temperature between room temperature and the glass transition temperature of the toner, and a compression stress of from 0.2 to 10 kgf/cm$^2$ at the middle temperature intermediate between the glass transition temperature and the softening temperature of the toner; and a carrier having a weight-average particle diameter of from 40 to 100 $\mu$m.

5. An electrostatic recording apparatus comprising:

means for developing an electrostatic latent image formed on an image carrier with a developer to form a toner image;

means for transferring said toner image onto a recording medium; and means for heating said recording medium having said toner image formed thereon under pressure given by a pair of fixing rolls to fix said toner image on said recording medium, wherein said developer comprises:

a toner having a volume-average particle diameter of from 6 to 10 $\mu$m, which exhibits a compression stress of from 50 to 500 kgf/cm$^2$ at the middle temperature between room temperature and the glass transition temperature of the toner, and a compression stress of from 0.2 to 10 kgf/cm$^2$ at the middle temperature intermediate between the glass transition temperature and the softening temperature of the toner; and a carrier having a weight-average particle diameter of from 40 to 100 $\mu$m.

* * * * *